US005819919A

United States Patent [19]

O'Neal

[11] Patent Number: 5,819,919

[45] Date of Patent: Oct. 13, 1998

[54] RIBBON PACKET

[75] Inventor: Pamela A. O'Neal, Strongsville, Ohio

[73] Assignee: Novtex Corporation, North Adams, Mass.

[21] Appl. No.: 613,067

[22] Filed: Mar. 8, 1996

[51] Int. Cl.[6] ..... B65D 85/04

[52] U.S. Cl. ..... 206/49; 206/395; 206/476; 206/227

[58] Field of Search ..... 206/49, 388, 476, 206/477, 482, 483, 395, 227, 63.3, 380, 382

[56] References Cited

U.S. PATENT DOCUMENTS

| | | | |
|---|---|---|---|
| 1,868,601 | 7/1932 | Harris | 206/388 |
| 2,839,185 | 6/1958 | Isaacs | 206/63.3 |
| 4,161,075 | 7/1979 | Eubanks et al. | 206/388 |
| 4,258,843 | 3/1981 | Wymer | 206/63.3 |
| 4,437,618 | 3/1984 | Boyle | 206/49 |
| 5,249,682 | 10/1993 | Transue | 206/483 |

*Primary Examiner*—Paul T. Sewell
*Assistant Examiner*—Nhan T. Lam
*Attorney, Agent, or Firm*—Patrick J. Walsh

[57] ABSTRACT

A display package for ribbon and like materials in which a length of ribbon is wound onto a supporting blank preferably fabricated of paperboard which partially encloses the wound ribbon and partially exposes the ribbon for inspection and evaluation by purchasers.

6 Claims, 2 Drawing Sheets

RIBBON PACKET

BACKGROUND OF THE INVENTION

The present invention relates to packaging and particularly to a package for retail display and sale of ribbon.

SUMMARY OF THE INVENTION

The present invention comprises a retail display package for ribbon and like materials in which a length of ribbon is wound onto a supporting blank preferably fabricated of paperboard which partially encloses the wound ribbon and partially exposes the ribbon for inspection and evaluation by retail purchasers. The paperboard blank is printed with manufacturer's marks as well as product information, and is displayed by hanging from a display rack. In this description, the assembly of ribbon and supporting blank is referred to as a ribbon packet.

In accordance with the invention, the supporting blank may be fabricated of any suitable pliable material and preferably comprises an elongate paperboard blank folded upon itself along a transverse scoreline to form over and under panels. The under panel is of generally rectangular configuration and has recessed opposite side edges defining a spool for securely winding a length of ribbon. The over panel is of generally triangular configuration characterized by one side edge extending upward and diagonally across the packet from the panel base to the top of the packet, and there, a narrow top end of the over panel is joined to the under panel by a slit and slot connection to complete the packet. Ribbon wrapped about the spool is partially exposed to one side of the diagonal edge. The facing portions of the paperboard blank, i.e., the front face of the over panel and the upper portion of the under panel are printed or decorated with package coloring, trademarks, and product information. The under panel at top has a central opening for hanging the packet from a display rack.

The ribbon packet provides a consumer package for presenting to the consumer a specific length of product (e.g., ribbon) and surpasses the retail practice of measuring and cutting a specific length of braid from a bolt at the point of purchase. Now, a consumer selects one or more ribbon packets containing the desired length of braid.

OBJECTS OF THE INVENTION

It is an object of the invention to provide a packet for retail display of ribbon or other similar strip materials used for embellishing crafts, dolls, wearables and home decor.

It is an object of the invention to provide a ribbon packet in which a length of ribbon is wound onto a supporting blank with the ribbon partially enclosed in the blank for retail inspection and evaluation, and with exposed portions of the packet printed with information useful to the consumer.

It is a further object of the invention to provide an inexpensive ribbon packet that is suitable for retail display and sale, and which can be used by the consumer for keeping unused portions of ribbon until the packet is empty.

Another object of the invention is to provide a consumer package surpassing the retail practice of measuring and cutting a specific length of braid from a bolt at the point of purchase.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
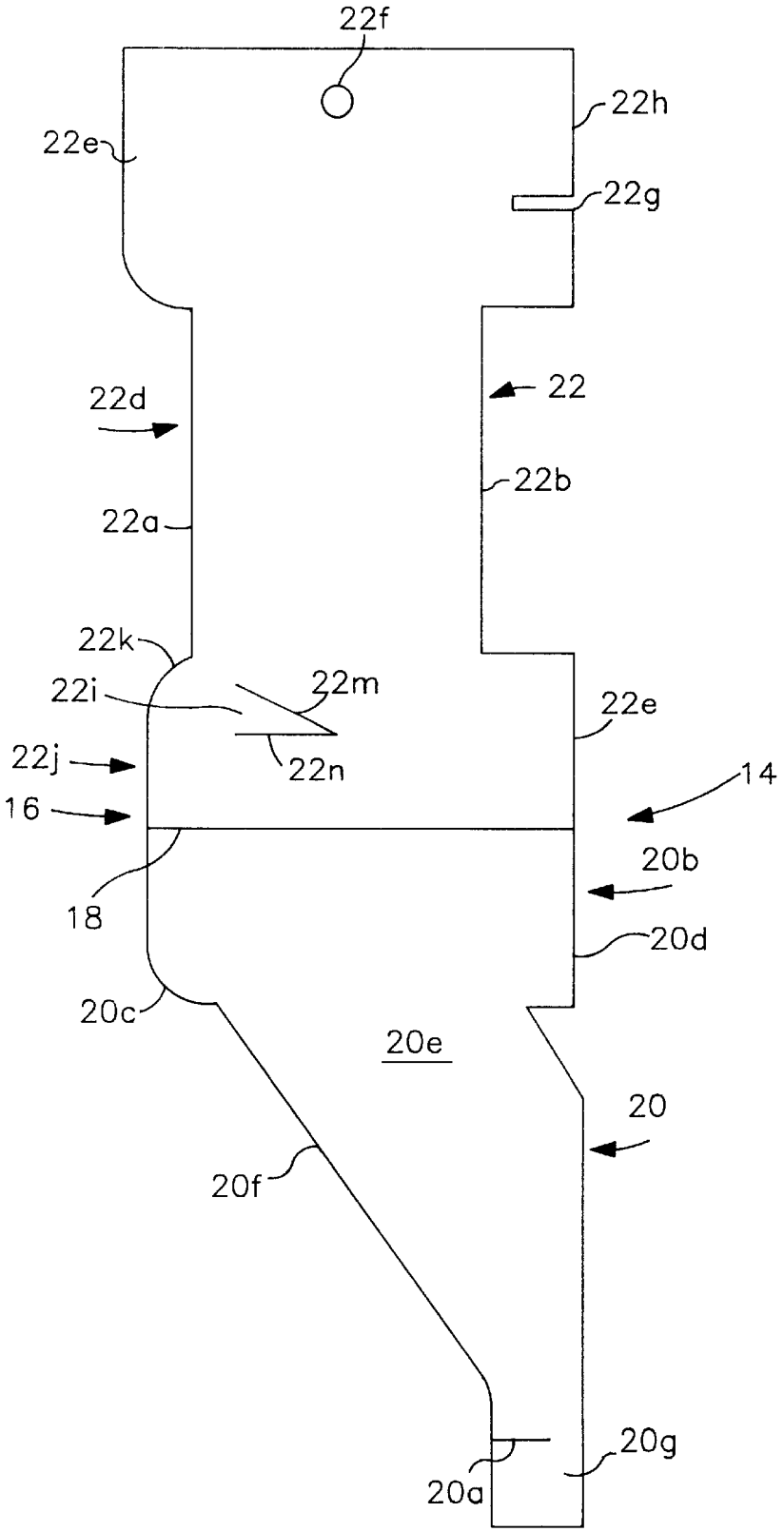
FIG. 1 is an articulated plan view of the supporting blank forming part of the invention.
Figure 2:
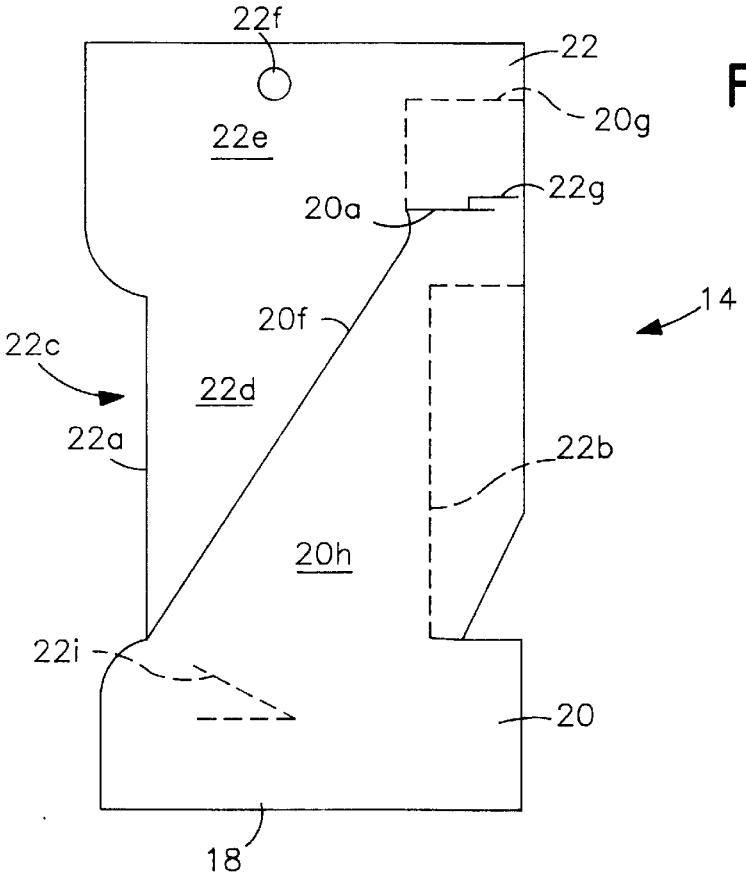
FIG. 2 is a front elevation view of the blank of FIG. 1 showing positions of the over and under panels when the blank is folded.

Referring now to the drawing, the invention comprises a retail display package assembly 10 including a length of ribbon 12 wound onto a supporting blank 14.

The blank 14 shown in the drawing may be formed of any suitable sheet material that can be cut, scored, folded and decorated for purposes of the invention.

The supporting blank preferably comprises an elongate paperboard strip 16 divided along a transverse scoreline 18 to form over 20 and under 22 panels.

Figure 3:
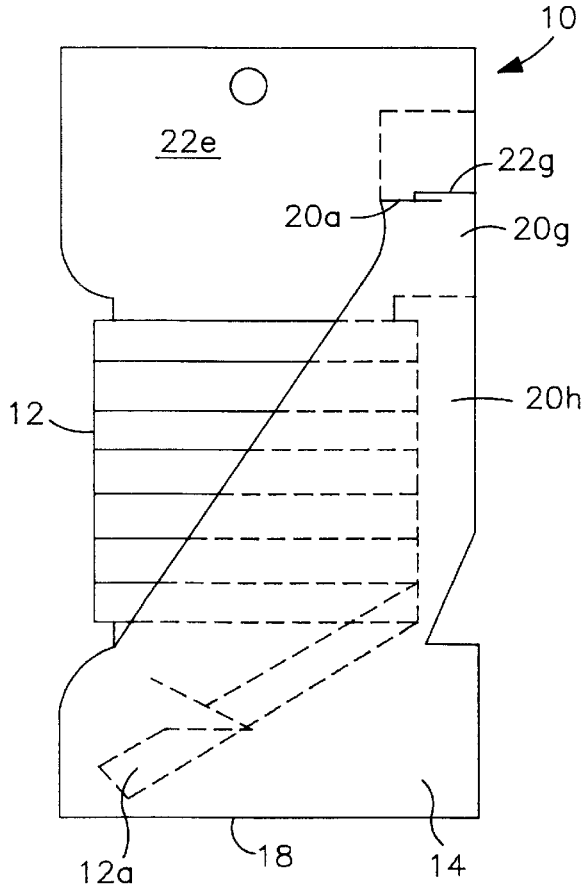
FIG. 3 is a front elevation view of the ribbon packet of the invention including the folded blank of FIG. 2 in assembly with a length of ribbon.

The under panel 22 is generally rectangular and has recessed opposite side edges 22*a*, 22*b* along the mid-section 22*c* of the panel defining a flat spool 22*d* for receiving a length of ribbon wound on the spool. The head space 22*e* of the under panel has a central hole 22*f* for hanging the packet from a retail display rack, and a closure slot 22*g* notched along a side edge 22*h* for cooperating with a corresponding closure slit 20*a* formed in the over panel. The head space 22*e* of the under panel remains visible in the assembled packet and is decorated or printed with the vendor's trademark, product information and so forth. A V-shaped tab 22*i* is cut through the lower region or base 22*j* of the under panel below the lower end of the spool for the purpose of receiving and retaining the free end 12*a* of ribbon wound on the spool as shown in FIG. 3. The tab 22*i* lifts above the under panel surface along cut lines 22*m*, 22*n* for receiving and retaining the ribbon free end.

The over panel 20 comprises a lower portion or base 20*b* with edges 20*c*, 20*d* congruent with the corresponding edges 22*k*, 22*l* of the base of the under panel, and a generally triangular upper portion 20*e* characterized by a side edge 20*f* extending upward and diagonally across the ribbon spool 22*d* from the panel base terminating in a narrow top end 20*g*. The top end is joined to the under panel by engaging slit 20*a* with slot 22*g* to close the packet. The outer surface 20*h* of the over panel may be decorated with trade dress, product information and so forth.

As shown in FIG. 3, ribbon wrapped about the spool is partially exposed to one side of the diagonal edge 20*f* with the enclosed free end 12*a* secured under the retaining tab.

The ribbon packet provides an inexpensive and useful article for attractively displaying ribbon or other decorating material allowing the purchaser to inspect and evaluate the product at point of purchase.

Various changes may be made to the structure embodying the principles of the invention. The foregoing embodiment is set forth in an illustrative and not in a limiting sense. The scope of the invention is defined by the the claims appended hereto.

I claim:

1. A supporting blank for assembly with a length of ribbon into a ribbon packet comprising an elongate sheet blank having a transverse scoreline to form over and under panels, the under panel having a head space, a base, and a spool defined by recessed opposite side edges of the under panel for securely winding a length of ribbon, the over panel having a base portion adjacent the scoreline and a generally triangular upper portion characterized by one side edge extending upward and diagonally across the spool from the over panel base and terminating in a narrow top end, the over panel being in partial covering relation to ribbon wound on the spool and means for engaging the over and under panels above the spool for partially enclosing ribbon wrapped about the spool with the ribbon on the spool being visible along said one side edge.

2. A supporting blank as defined in claim 1 in which the means for engaging the over and under panels comprises a slit in one of said panels, and a slot in the other of said panels, and with the slit and slot in registry for interlocking the over and under panels.

3. A supporting blank as defined in claim 1 in which the length of ribbon has a free end and the base of the under panel is incised to form a tab for retaining the free end of ribbon wound on the spool.

4. A supporting blank as defined in claim 1 in which the head space has a small opening for hanging a ribbon packet from a display rack.

5. A supporting blank for assembly with a length of ribbon into a ribbon packet comprising an elongate paperboard blank having a transverse scoreline dividing the blank into over and under panels, the under panel being of generally rectangular configuration and having a head space, a base, and a spool defined by recessed opposite side edges of the under panel for securely winding a length of ribbon, the spool being positioned between the head space and the base of the under panel, the over panel having a base portion adjacent the scoreline and a generally triangular upper portion characterized by one side edge extending upward and diagonally across the spool from the over panel base and terminating in a narrow top end, the over panel being in partial covering relation to ribbon wound on the spool means for interlocking the over and under panels above the spool for partially enclosing ribbon wrapped about the spool with the ribbon on the spool being visible along said one side edge, said length of ribbon having a free end, and a tab formed from the base of the under panel for retaining the free end of ribbon wound on the spool.

6. A ribbon packet comprising a supporting blank in assembly with a length of ribbon, the supporting blank being an elongate sheet blank having a scoreline dividing the blank into over and under panels, the under panel having a head space, a base, and a spool defined by recessed opposite side edges of the under panel, a length of ribbon and the like wound on the spool with the ribbon having a free end, the over panel having a base portion adjacent the scoreline and an upper portion extending from the over panel base to the top of the packet terminating in a narrow top end, the over panel upper portion partially covering the wound ribbon, means for interlocking the over and under panels above the spool for partially enclosing ribbon wrapped about the spool with the ribbon being visible to one side of the upper portion of the over panel, and means formed from the base of the under panel for retaining the free end of ribbon wound on the spool.

* * * * *